US006708735B1

(12) United States Patent
Kenihan

(10) Patent No.: US 6,708,735 B1
(45) Date of Patent: Mar. 23, 2004

(54) DISPENSING LID CLOSURE FOR CONFECTIONS AND METHODS OF MAKING AND USING THE CLOSURE

(76) Inventor: Antony Austin Kenihan, 9 Rimrock, Irvine, CA (US) 92612

( * ) Notice: Subject to any disclaimer, the term of this patent is extended or adjusted under 35 U.S.C. 154(b) by 0 days.

(21) Appl. No.: 10/316,085

(22) Filed: Dec. 11, 2002

(51) Int. Cl.[7] ..... B65B 1/04; B65D 77/00

(52) U.S. Cl. ..... 141/18; 141/100; 141/104; 141/110; 141/112; 206/217; 206/219; 206/222

(58) Field of Search ..... 141/18, 330, 100, 141/104, 110, 112; 220/521, 212; 206/217, 219, 221, 222

(56) References Cited

U.S. PATENT DOCUMENTS

| | | | | | |
|---|---|---|---|---|---|
| 2,824,010 | A | | 2/1958 | Pedersen | 99/171 |
| 3,039,644 | A | | 9/1962 | Lefcort | 220/20 |
| 3,305,368 | A | | 2/1967 | Bourelle | 99/171 |
| 3,326,363 | A | | 6/1967 | Bennett et al. | 206/47 |
| 3,603,469 | A | * | 9/1971 | Magni | 206/222 |
| 3,743,520 | A | | 7/1973 | Croner | 99/171 |
| 3,779,372 | A | | 12/1973 | de Lloret | 206/47 |
| 3,796,813 | A | | 3/1974 | Kurland | 99/78 |
| 4,024,952 | A | * | 5/1977 | Leitz | 206/221 |
| 4,785,931 | A | | 11/1988 | Weir et al. | 206/222 |
| 4,982,875 | A | * | 1/1991 | Pozzi et al. | 222/83 |
| 5,035,320 | A | | 7/1991 | Plone | 206/219 |
| 5,052,553 | A | | 10/1991 | De Sanctis | 206/222 |
| 5,236,022 | A | | 8/1993 | Husted | 141/358 |
| 5,431,276 | A | | 7/1995 | Lialin | 206/202 |
| 5,529,179 | A | | 6/1996 | Hanson | 206/219 |
| 5,711,420 | A | | 1/1998 | Spring | 206/222 |
| 5,772,017 | A | * | 6/1998 | Kang | 206/222 |
| 5,885,635 | A | | 3/1999 | Spring et al. | 426/120 |
| 5,934,493 | A | | 8/1999 | Han | 215/227 |
| 5,979,647 | A | | 11/1999 | Han | 206/222 |
| 6,105,760 | A | | 8/2000 | Mollstam et al. | 206/222 |
| 6,170,654 | B1 | | 1/2001 | Gartner et al. | 206/219 |
| 6,209,718 | B1 | | 4/2001 | Mollstam et al. | 206/222 |
| 6,412,526 | B2 | * | 7/2002 | Castillo | 141/100 |

OTHER PUBLICATIONS

US 2002/0096440 A1; Jul. 25, 2002; Kasuya.*

* cited by examiner

*Primary Examiner*—Gregory L. Huson
*Assistant Examiner*—Khoa Huynh
(74) *Attorney, Agent, or Firm*—Blank Rome LLP

(57) ABSTRACT

A lid closure for dispensing a confection into a refreshment, such as a milk shake, in a container comprises first and second molded lid parts with the first lid part having a central opening into which the second lid part is removably inserted. A sealing layer with a circular tear line encloses the confection in an annular compartment in the first lid part and is attached to the second lid part at the center of the sealing layer. The second lid part has two pockets for engagement by the thumb and forefinger of a consumer. To dispense the confection into the refreshment, the consumer twists the second lid part to tear the sealing layer along the tear line and removes the second lid part and a portion of the sealing layer from the central opening in the first lid part.

21 Claims, 5 Drawing Sheets

DISPENSING LID CLOSURE FOR CONFECTIONS AND METHODS OF MAKING AND USING THE CLOSURE

BACKGROUND OF THE INVENTION

1. Field of the Invention

The present invention relates to lid closures for containers and methods of making and using the lid closures, and more particularly to a molded plastic lid closure having a compartment for holding solid or particulate confections to be dispensed by gravity into the container by a consumer and methods of making and using the same.

2. Description of the Prior Art

Plastic lid closures for sealing beverage containers, such as containers purchased by consumers at so-called "fast-food" restaurants and "convenience" stores are well known in the art. It has also been heretofore proposed to provide pockets or compartments in molded plastic lid closures that contain solid and liquid materials for use by a consumer to dispense into a container of a beverage to which the lid closure is secured. The solid materials that are dispensed into the container are typically granular materials, such as powdered cream or sugar for a coffee or tea beverage. One such proposed lid closure is described in U.S. Pat. No. 3,326,363 to Bennett et at. The lid closure described in the Bennett et al. patent is molded of a polystyrene plastic material with a generally U-shaped annular skirt for engaging the rim of a paper or plastic container. The molded lid is provided with a plurality of pockets containing granular materials that are closed and sealed on the underside of the lid by a circular sealing sheet of a tearable metal foil or plastic film. The lid is further provided with a pair of triangular bottom wall sections that are designed to tear the circular sealing sheet on the underside of the lid when pressure is applied by a consumer to the top of the lid at one of the pockets thereby releasing the granular material into the container.

A number of other dispensing lid closure proposals for beverage containers have been heretofore made, as exemplified by the lid closures disclosed in U.S. Pat. No. 3,796,813 to Kurland; U.S. Pat. No. 4,785,931 to Weiret al.; U.S. Pat. No. 5,431,276 to Lialin; and U.S. Pat. No. 5,529,179 to Hanson. Typically, the prior art lid closures of these patents involve the application of pressure by the consumer to a pocket or compartment in the lid to release an ingredient or material into the container to which the lid is attached. In the case of the patents to Weir et al. and Lialin, the lid closures are formed or provided with plungers or piercing devices for rupturing a foil or membrane forming the bottom wall of the compartments in the lid.

Other prior art lid dispensing proposals include containers for dispensing larger solid components, such as tablets, into a beverage or other liquid. Examples of such dispensing lid proposals are described in U.S. Patent No. 3,743,520 to Croner and U.S. Pat. No. 6,105,760 to Mollstam et al. U.S. Pat. No. 5,236,022 to Husted discloses a lid with a built-in dispensing scoop for dry foodstuffs.

None of the aforementioned prior art proposals provides a dispensing lid especially adapted for dispensing confections, such as individual pieces of candy, into a container containing a beverage. In the case of soft or frangible confections, such as the popular Butterfinger® and M&M® brand candies, application of manual pressure to the lid for the purpose of puncturing or rupturing a sealing layer to dispense the confections from lid compartments is particularly undesirable because of the potential to mar or crush the confections and make them difficult to dispense as well as unsightly to the consumer.

Accordingly, it would be desirable to provide a dispensing lid closure for dispensing from a sealed lid compartment any type of solid or liquid material contents, but particularly confections and especially crushable candies, that does not involve the application of manual pressure to the lid or puncturing the lid to dispense the contents of the lid compartment.

SUMMARY OF THE INVENTION

The present invention overcomes the drawbacks of the prior art dispensing lid closures by providing a simple, two-part molded, thermoformed or vacuum-formed plastic lid closure for a container. The first molded part of the lid closure has a central opening formed by a generally cylindrical sleeve that may be vertical or slightly inwardly tapered from top to bottom. The height of the first molded part may be varied to increase or decrease the dispensable volume of the lid closure. The opening is surrounded by an annular section or compartment with an annular skirt at its outermost periphery for sealingly engaging the rim of a container. A sealing layer is sealingly secured to a narrow annular surface on the bottom of the first molded lid part to form a closed annular compartment adapted to contain the material or confection to be dispensed. The sealing layer is perforated or weakened radially inwardly of the narrow annular surface of the first lid part along a circular perforation or weakened line.

The second molded lid part comprises a twist-off-pull-out, generally cylindrical but slightly tapered cap adapted to removably fit into and mate with the inwardly tapered central sleeve in the first lid part. Preferably, the second lid part is molded with two oppositely disposed semi-cylindrical pockets sized so that a consumer can insert the tips of a thumb and forefinger for a purpose to be described hereinafter. The second lid part is securely affixed at its lowermost end or bottom to the sealing layer radially inwardly of the circular perforation in the sealing layer.

The two lid closure parts are preferably molded or vacuum-formed of a natural polystyrene plastic material of the type conventionally used to manufacture lid closures for beverage containers. A transparent plastic material may also be used so that the consumer may view the confection or material contained in the dispensing lid closure. Moldable or vacuum-formable plastic materials other than polystyrene may also be used to manufacture the lid closure parts, such as polypropylene, polyethylene terephthalate (PET), high-density polyethylene (HDPE) or expanded polyethylene (EPE). An especially preferred material for making the lid closure parts is a coextruded polystyrene/polyethylene sheet material, which is heat sealable, or any other coextruded combination of a vacuum-formable lid material with a heat sealable exterior layer that is disposed on the underside of the lid closure parts.

Preferably, the sealing layer comprises a metal foil or polymeric layer having a circular shape although other shapes are possible. A preferred material for the sealing layer is aluminum foil that is adhesively affixed to the annular sealing surface on the underside of the first part of the lid closure and is also adhesively affixed to the underside or bottom of the second lid part or twist-off-pull-out cap. The foil may have an adhesive layer applied over the entire area of one of its surfaces or in a pattern only to those areas of the foil that contact the sealing surfaces on the underside of the first and second lid parts. Alternatively, the first and second lid parts may have an adhesive layer applied to their underside surfaces as described hereinafter. The adhesive layer may be any suitable adhesive used in the food packaging industry, such as linear low-density polyethylene (LLDPE). Other polymeric materials may also be used for the adhesive layer, such as ethylene acrylic acid (EAA), polyethylene, low density polyethylene (LDPE), Surlyn®, a polymeric resin made by du Pont, ethylene vinyl alcohol (EVOH) or Barex®, an acrylonitrile-methyl acrylate copolymer made by BP Amoco, polyvinylidene chloride (PVDC) film, such as Saran® made by Dow Chemical Company, or any other suitable copolymer or homopolymer.

The second lid part is preferably sealingly secured in the central sleeve or opening of the first lid part by an adhesive label or decal. The label or decal covers the top of the second lid part or cup and extends radially beyond the cup so as to seal to an annular sealing surface located on the top of the first lid part surrounding the central sleeve or opening. Alternatively, the second lid part may be provided with an annular rim with a low-tack adhesive applied to the underside thereof for sealing to a mating annular surface on the top of the first lid part. When the first and second lid parts are assembled together as described, the annular compartment of the lid closure is ready for filling.

The annular compartment of the dispensing lid closure of the invention is preferably filled with a confection, candy or other material by inverting the lid closure so that the annular compartment is upwardly open, and then charging a predetermined quantity or volume of confection, candy or other material into the compartment, typically a volume of 46 cubic inches. The sealing layer is then adhesively or heat sealingly bonded to the annular sealing surface of the first lid part and to the bottom surface of the second lid part when the lid closure is in its inverted filling position to seal the confection, candy or other material in the compartment. It is also contemplated that the first lid part can be filled with confection and sealed with the sealing layer before the first and second lid parts are assembled together. Thereafter, the second lid part is inserted into the central sleeve of the first lid part and affixed to the sealing layer. An especially preferred combination of materials for the lid closure parts and the sealing layer is a single sheet aluminum foil sealing layer and a lid closure made of the above-mentioned coextruded polystyrene/polyethylene vacuum-formable sheet material wherein the polyethylene layer of the lid closure parts is heat sealable.

The completed dispensing lid closures may then be packaged in packages of single or multiple lids for wholesale or retail distribution, or for use in the "fast food" industry or the "convenience store" industry. In that regard, during the lid molding or forming process, trademarks, logos, instructions for use and other indicia may be molded into the plastic material of the lid closure parts. In addition, the label or decal sealed over the twist-off-pull-out cap, when used, may be printed with trademarks, logos, instructions for use and other indicia.

One preferred form of packaging comprises a cylindrical dispensing sleeve made of cardboard, plastic or other suitable material that contains a plurality of charged or filled lid closures stacked one above the other with a means to dispense individual lid closures from one end of the sleeve. The sleeve may be mounted to a vertical wall surface, e.g., in a "fast food" establishment or a "convenience" store, with the longitudinal axis of the sleeve oriented vertically. Alternatively, the sleeve may be a disposable element inserted in a permanent, wall-mounted dispenser.

To use an assembled dispensing lid closure of the invention, the annular skirt of the first lid part is attached to the rim of a container or cup containing a beverage or other refreshment, such as a milk shake for example. The confection or candy is enclosed in the annular compartment by the sealing layer and is disposed over the container. If it is desired to dispense the contents of the lid closure compartment into the container, the label or decal is first peeled away from the top of the lid closure to expose the pockets in the twist-off-pull-out cap. The consumer then places a thumb and forefinger in a respective pocket and manually twists the cap clockwise or counterclockwise until the sealing layer tears along the circular perforation or weakened line. As the cap is rotated to tear the sealing layer, the cap and the torn-away portion of the sealing layer located radially inside the circular perforation or weakened line are also pulled out of or withdrawn from the central opening or sleeve in the first lid part. At the same time, the confection or candy in the annular compartment of the first lid part is dispensed by gravity into the beverage or refreshment, e.g., a milk shake, in the container to which the lid closure is attached. The twist-off-pull-out cap and attached sealing layer portion are then discarded.

The present invention is useful in a number of applications some, but not all, of which are described herein. Those skilled in the art will appreciate the various possible applications of the dispensing lid closure of the invention. In a preferred application, the dispensing lid closure of the invention is used to contain a confection for dispensing into a semi-solid refreshment, such as a milk shake, but may be used to dispense confections, such as the aforementioned Butterfinger® and M&M® brand candies, Smarties®, chocolate or rainbow "sprinkles" or "jimmies," nuts, energy, dietary and sports supplements and vitamins, as well as liquid, powdered or granular flavorants or other additives for a cold or hot beverage.

The invention has several objects, namely:

(1) to achieve a simpler design of a confection-dispensing lid closure;

(2) to decrease costs by replacing complex, multi-part lid designs with a plastic molded lid closure;

(3) to provide a dispensing lid closure design that is especially suitable for mass production;

(4) to provide a dispensing lid closure designed especially for use in the "fast food" and "convenience store" industries to add confections to semi-solid beverages; and (5) to provide a novel product that integrates the confection industry with the ice cream, health and sports drink and juice industries.

With these and other objects, advantages and features of the invention that may become hereinafter apparent, the nature of the invention may be more clearly understood by reference to the following detailed description of the invention, the appended claims and to the several drawings attached herein.

DETAILED DESCRIPTION OF THE INVENTION

Figure 2:
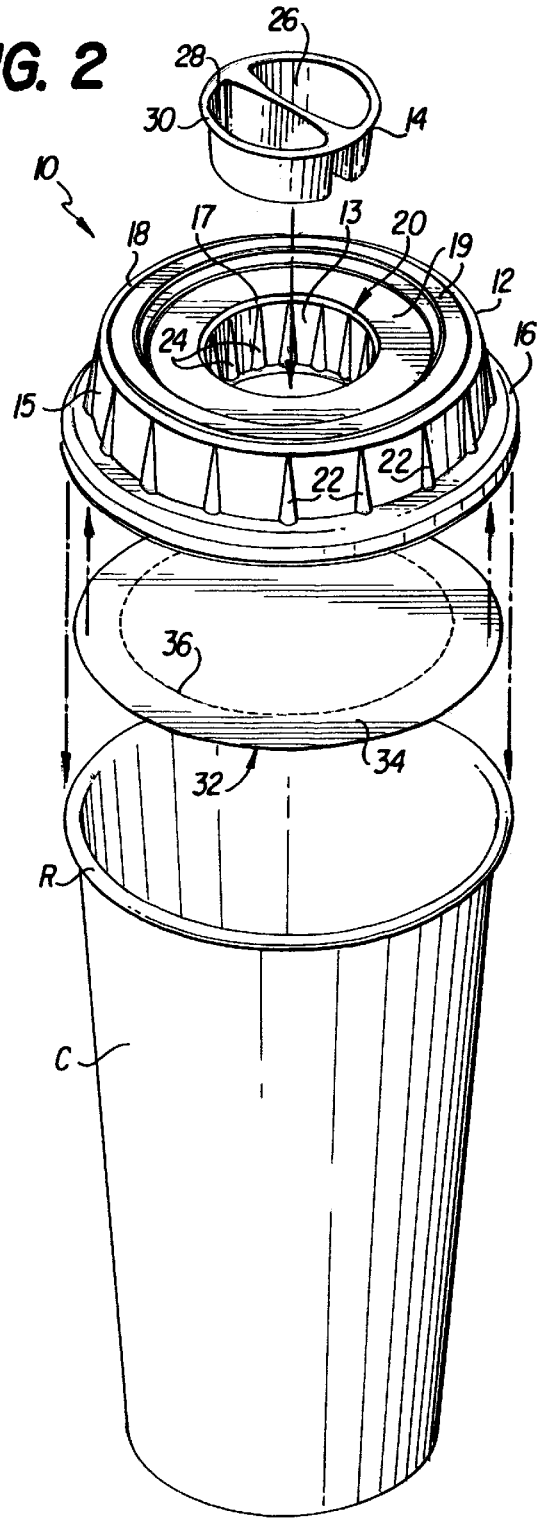
FIG. 2 is an exploded perspective view of the embodiment of the dispensing lid of FIG. 1.
Figure 1:
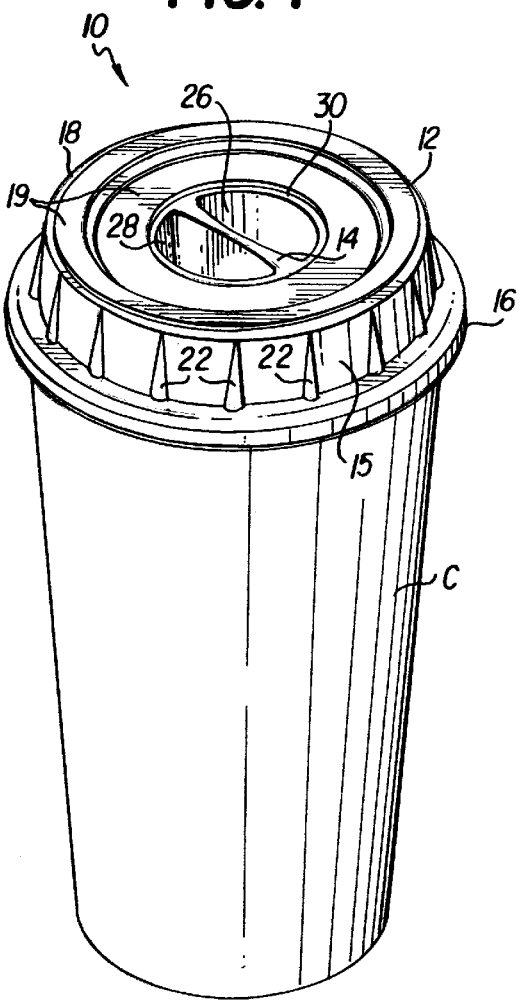
FIG. 1 is a perspective view of an embodiment of the dispensing lid of the invention shown attached to a beverage container.

Referring now to FIGS. 1 and 2, there is shown a preferred embodiment of the invention in the form of a dispensing lid closure 10 for a beverage container C, which may be of any size. Lid closure 10 is preferably molded or formed by a conventional manufacturing process, such as vacuum forming, from a thin sheet of plastic material, such as polystyrene.

As seen in FIG. 2, the lid 10 is formed in two parts, a first lid part 12 and a second lid part 14, which are preferably separately formed and may have different wall thicknesses. First lid part 12 is provided with an annular skirt or lip 16 adapted to sealingly engage the upper rim R of the beverage container C in a conventional manner. Elevated above the skirt 16 is a raised annular section or compartment 18 with a central bore or sleeve 20 (FIG. 2). Annular compartment 18 may be provided on its inner and outer circumferential walls 13, 15 with stiffening ribs 22, 24, respectively. Second lid part 14 comprises a generally cylindrical cap with a pair of integrally formed semi-cylindrical pockets 26, 28 of a size suitable to receive the tips of the thumb and forefinger of a consumer. Second lid part 14 is also provided with a peripheral annular flange 30 that engages an annular shoulder 17 on the first lid part 12.

Annular surfaces 19 on the first lid part 12 may be provided with indicia, such as trademarks, logos and the like to identify the contents of the dispensing lid, the supplier of the dispensing lid and other marketing information. Preferably, the indicia is formed directly into the lid when it is molded or vacuum formed, but it may also be applied after molding or forming by printing, adhesive labeling or by any other suitable method.

Figure 5:
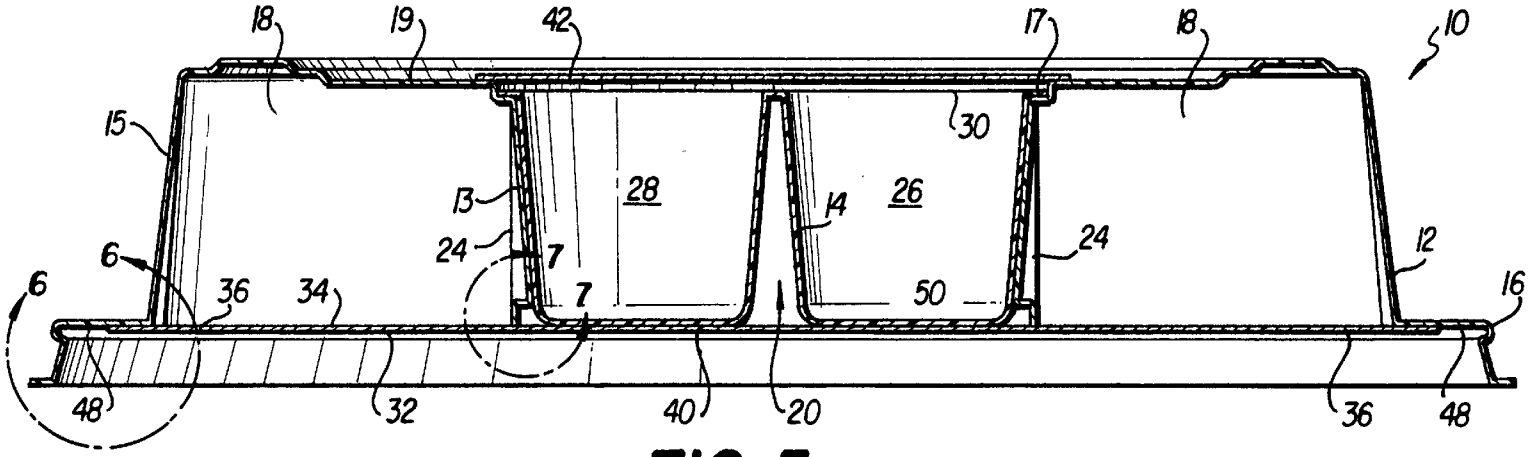
FIG. 5 is a cross-sectional view of the dispensing lid of the invention taken along line 5—5 of FIG. 4.
Figure 7:
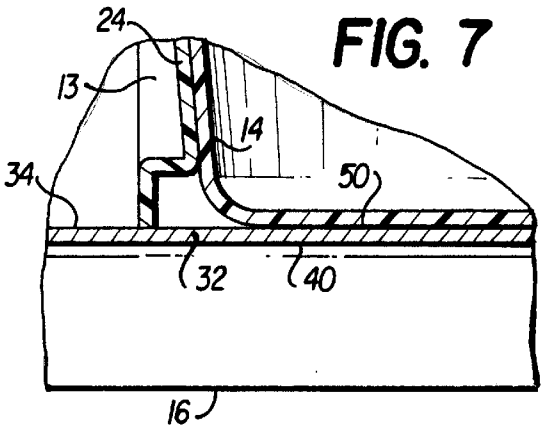
FIG. 7 is a fragmentary detail 7—7 of the dispensing lid of FIG. 5 showing the attachment of the sealing layer to the second lid part.

After annular section or compartment 18 has been charged with a confection or other material, a circular sealing layer 32, made of metal foil, such as aluminum foil, or other single or multilayer sheet material, is sealingly affixed to sealing surfaces (not shown in FIGS. 1 and 2) of the first and second lid parts to seal the confection or other material in the annular compartment 18. Preferably, the sealing layer 32 is heat sealed to the sealing surfaces that are formed by a heat sealable layer of a coextruded lid closure material, such as a polystyrene/polyethylene coextrusion. Alternatively, the sealing layer 32 may have an adhesive applied to the entire upper surface 34 thereof or the adhesive may be applied in a predetermined pattern to selected portions of the upper surface. If the entire upper surface of the sealing layer 32 has an adhesive applied thereto, it is important to avoid bonding the inner circumferential wall 13 to the sealing layer. Accordingly, circumferential wall 13 is preferably spaced above the sealing layer as shown in FIGS. 5 and 7, for example.

The sealing layer 32 is perforated or weakened along a circular tear line 36 located radially inwardly of the outer circumferential wall 15 of the annular section 18. This tear line 36 is preferably formed by a tool or process that does not completely penetrate the sealing layer so that no minute openings are formed in the sealing layer that would prevent the sealing layer from forming a hermetic seal of the compartment containing the confection or other material. In the case of a sealing layer made of aluminum foil, a tool that coins the foil along the tear line to significantly reduce the foil thickness and tensile strength at the tear line is one suitable method of forming the tear line. Other suitable methods will be apparent to those skilled in the art in light of the teachings herein.

While the arrangement of the above-described preferred embodiment provides for one sealed compartment containing a confection, it will be understood that the invention is not limited to a one compartment dispensing lid closure. For instance, the annular compartment 18 may be divided into a plurality of smaller compartments adapted to contain different confections.

Figure 3:
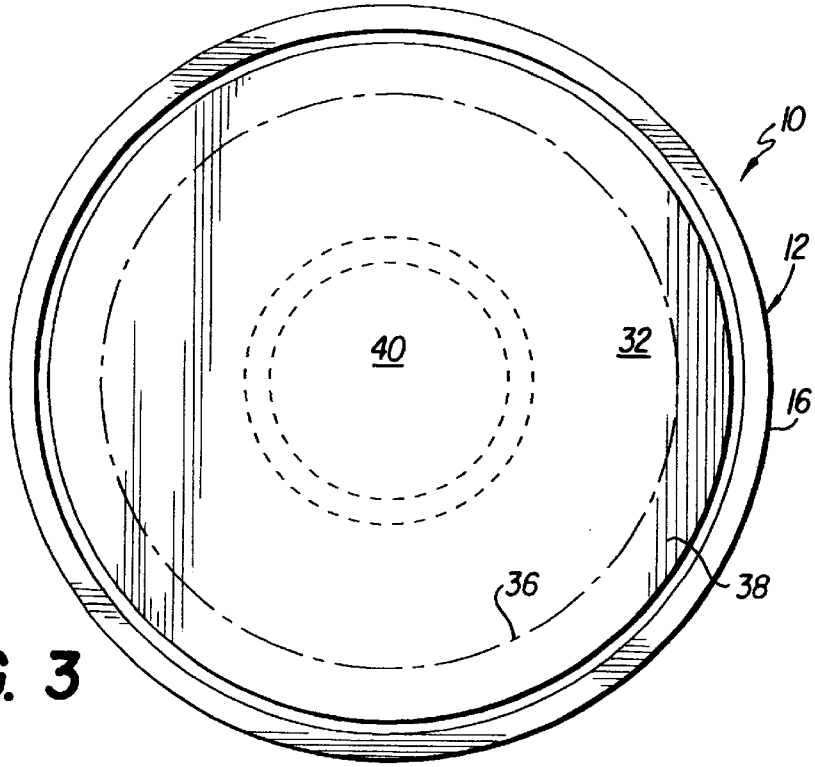
FIG. 3 is a bottom plan view of the dispensing lid of the invention showing the perforation in the sealing layer.
Figure 4:
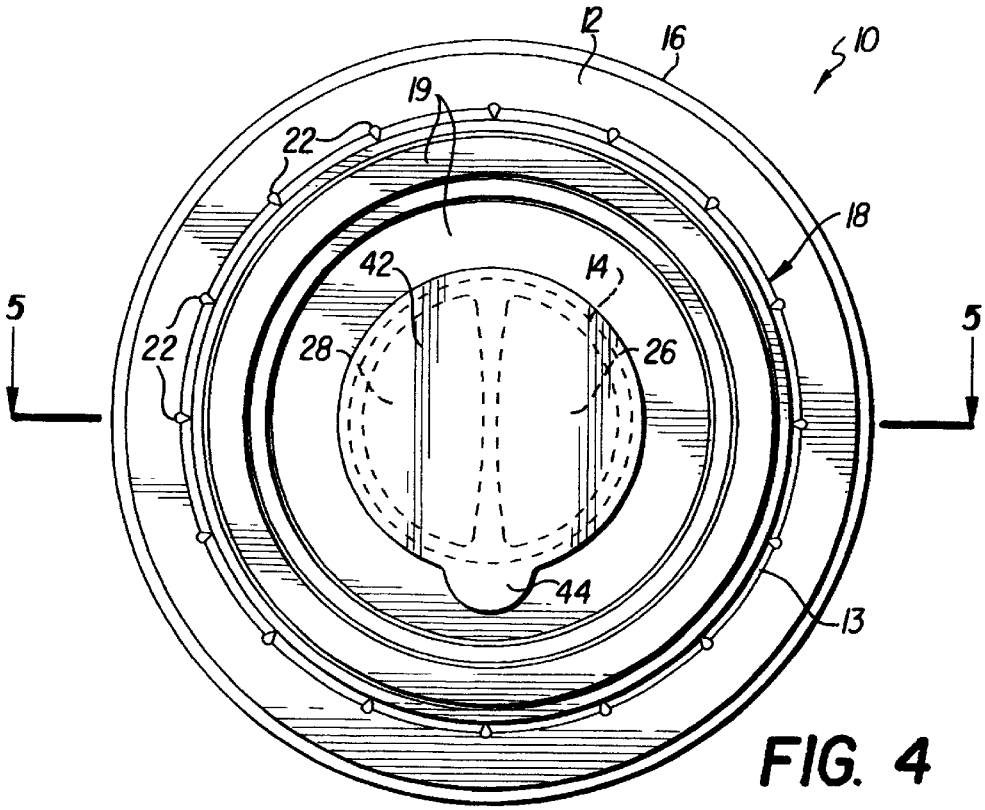
FIG. 4 is a top plan view of the dispensing lid of the invention showing the label or decal sealed over the twist-off-pull-out cap.

FIGS. 3 and 4 illustrate the bottom and top views respectively of the dispensing lid 10. Referring to FIG. 3, the circular sealing layer 32 is sealed to the first lid part 12 in the annular region 38 radially outwardly from the tear line 36. The sealing layer 32 is also attached, preferably adhesively, to the bottom of the second lid part 14 in the central circular region 40. Referring to FIG. 4, the second lid part 14 shown in dashed lines is sealed in the central sleeve of the first lid part 12 by an adhesive-backed label or decal 42 with a tear tab 44 extending from the periphery thereof. The label or decal 42 is made of paper, foil or a paper/foil laminate and may be provided with printed indicia, such as trademarks, logos, instructions for use or the like.

Markings may also be provided on the annular surfaces 19, 30 of the first and/or second lid parts 12, 14 to instruct the consumer how to operate the dispensing lid closure, e.g., to indicate the angular extent the second lid part 14 should be rotated with respect to the first lid part 12 and the angular position at which the second lid part 14 should be pulled from the first lid part 12. Such markings will insure that the second lid part 14 is rotated sufficiently to permit tearing of the circular sealing layer 32 along the tear line 36.

Figure 6:
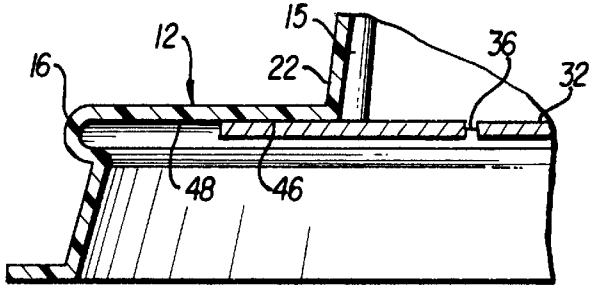
FIG. 6 is a fragmentary detail 6—6 of the dispensing lid of FIG. 5 showing the attachment of the sealing layer to the first lid part.

FIGS. 5–7 show in cross-section the completed assembly of one embodiment of the first and second lid parts 12, 14, the sealing layer 32 and the label 42. As shown, the second lid part 14 is disposed in the central opening or sleeve 20 of the first lid part 12 with flange 30 bearing on shoulder 17 and is peripherally engaged with the ribs 24, or with the inner circumferential wall 13 if the ribs 24 are not provided. The outer annular portion of sealing layer 32 is adhesively affixed or heat sealed at seal 46 to the annular surface 48 of the first lid part 12 with the perforated tear line 36 disposed radially inwardly of the annular surface 48. Preferably, the tear line 36 is located closely adjacent the outer circumferential wall 15 of the annular compartment 18 to avoid forming a horizontal annular "shelf" that may inhibit dispensing of the entire contents of the compartment 18. Central portion 40 of the sealing layer 32 is also adhesively affixed or heat-sealed at seal 50 to the bottom of second lid part 14. Decal or label 42 is adhesively secured to inner annular surface 19 over the second lid part 14 to seal the upper side of the dispensing lid 10 and secure the second lid part 14 in place until a consumer uses the dispensing lid 10. Annular compartment 18 is filled with a confection (not shown in FIGS. 5–7) or other material that is to be dispensed from the lid 10 in the manner to be described in connection with FIGS. 11–12.

Figure 8:
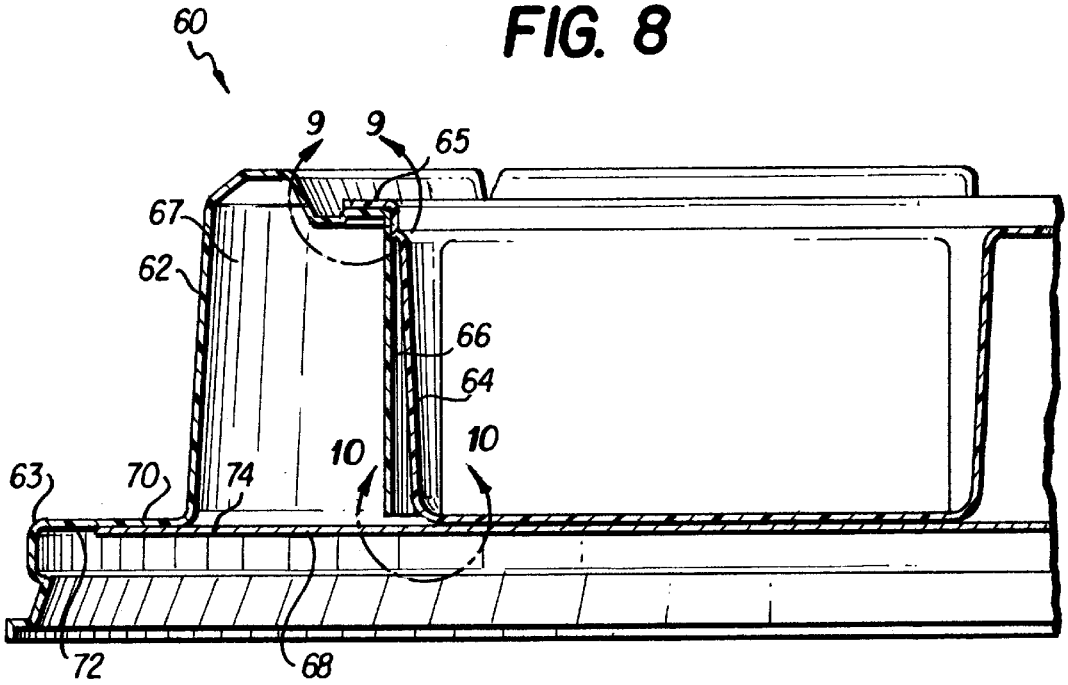
FIG. 8 is a partial cross-sectional view of another embodiment of the dispensing lid of the invention.
Figure 9:
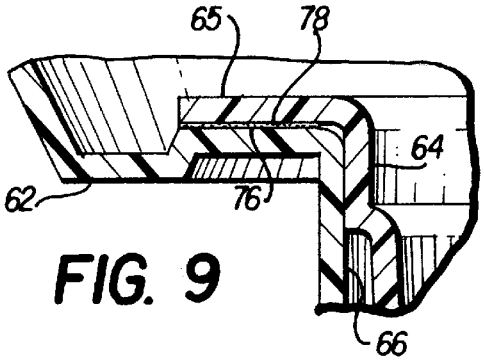
FIG. 9 is a fragmentary detail 9—9 of the dispensing lid of FIG. 8 showing the attachment of the second lid part to the first lid part with a low-tack adhesive.
Figure 10:
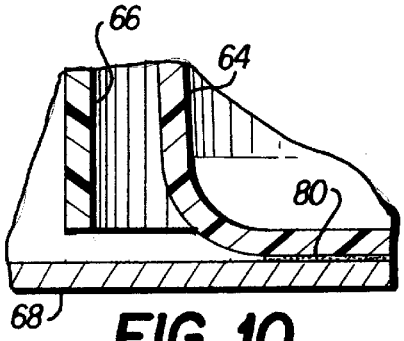
FIG. 10 is a fragmentary detail 10—10 of the dispensing lid of FIG. 8 showing the attachment of the sealing layer to the twist-off-pull-out cap.

FIGS. 8–10 illustrate another embodiment of the dispensing lid of the invention. In this embodiment, the dispensing lid 60 has a first lid part 62 with an annular skirt 63 and a second lid part 64 with an annular flange 65. The first lid part 62 is provided with a larger diameter central opening or sleeve 66 than the first embodiment and the annular compartment 67 has a smaller volume than the volume of the annular compartment 18 of the first embodiment. This embodiment is especially useful for dispensing small, granular confections, such as "jimmies" or "sprinkles," onto the top of milk shakes, ice cream and other semi-solid refreshments. The larger diameter central opening 66 also facilitates the use of a spoon or drinking straw for consuming the contents of a container or cup to which the dispensing lid 60 is attached.

Sealing layer 68 is adhesively affixed or heat sealed at seal 70 to annular shoulder 72 of the first lid part 62 with a circular perforation or tear line 74 disposed radially inwardly of the seal 70. In this embodiment, no label or decal is necessary because the flange 65 of the second lid part 64 is adhesively bonded with a low-tack adhesive 76 to annular surface 78 of the first lid part 62 (FIG. 9) before or after the first lid part has been filled with a confection. Sealing layer 68 is also securely bonded by an adhesive 80 to the bottom of the second lid part 64 (FIG. 10).

In an alternative embodiment, instead of using the decal or label 42 or the low-tack adhesive 76 to seal the second lid part 14 to the first lid part 12, the lowermost end of the inner circumferential wall 13 (FIGS. 5 and 7) or the lowermost end of sleeve 66 (FIGS. 8 and 10) may extend downwardly to the sealing layer 32, 68 and a low-tack adhesive similar to low-tack adhesive 76 may be applied to the lowermost end of the wall 13 or sleeve 66 to form a seal which is broken by the consumer when the second lid part 14 is twisted as described below.

Figure 11:
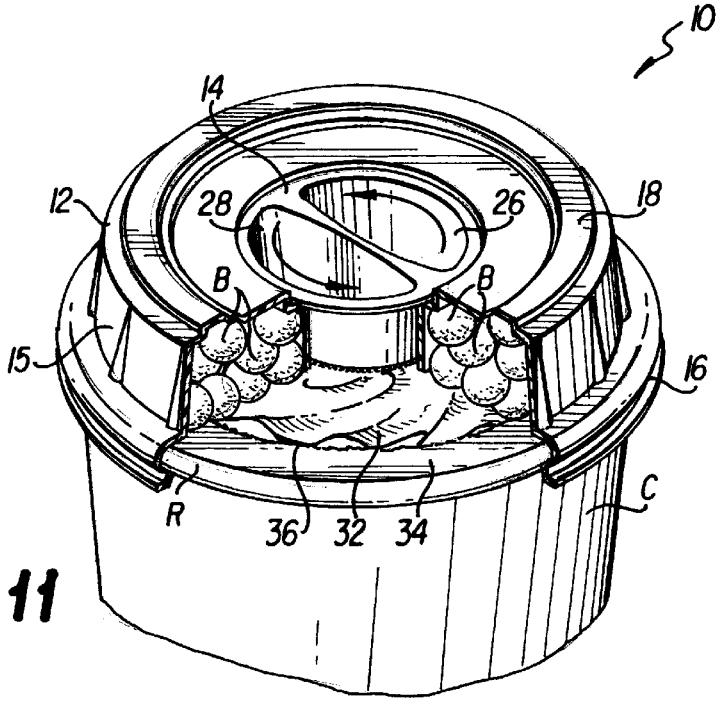
FIG. 11 is a partly broken perspective view of the dispensing lid of the invention showing the operation of the twist-off-pull-out cap for discharging a confection into a container.
Figure 12:
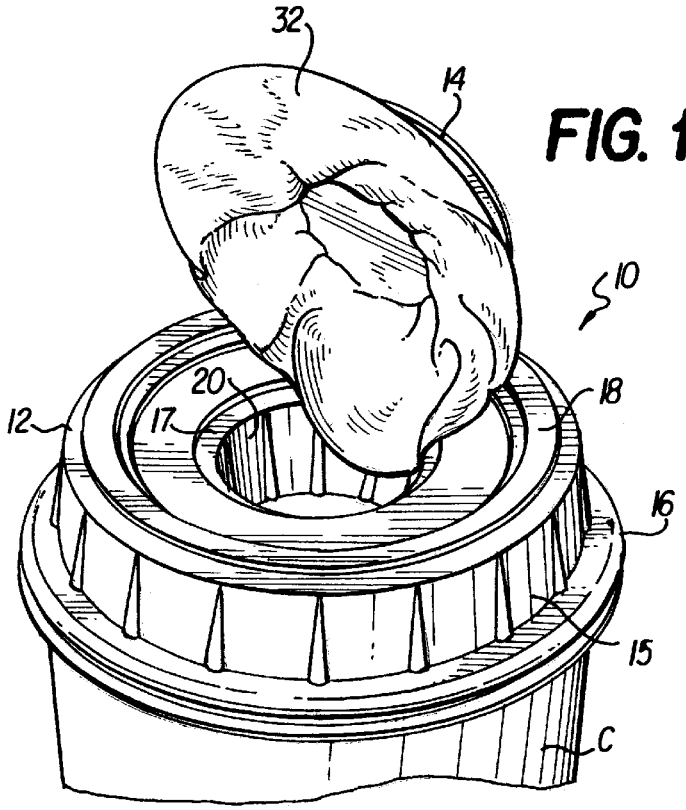
FIG. 12 is a partly broken perspective view of the dispensing lid of the invention showing the twist-off-pull-out cap and sealing layer portion removed from the first lid part.

The operation and use of the dispensing lid closure 10 (or 60) of the invention is illustrated in FIGS. 11 and 12. To use the lid closure 10 (or 60) containing a confection B, the lid closure is first attached to the rim R of a container, such as container C, containing a refreshment, such as a milk shake or other semi-solid drink, by means of the annular skirt 16 and the label or decal (if present) is peeled off the top of the second lid part 14 (or 64). To dispense the confection B from the annular compartment 18 (or 67), the consumer places the tips of a thumb and forefinger into the pockets 26, 28 and twists the second lid part clockwise and/or counterclockwise as shown by the arrows in FIG. 11 to tear the sealing layer 32 (or 68) along the circular tear line 36 (or 74). At the same time the second lid part is twisted to tear the sealing layer, the second lid part 14 is pulled upwardly and outwardly as shown in FIG. 12 to separate the second lid part and that portion of the sealing layer 32 adhered to the second lid part from the first lid part 12. Since the confections B in the compartment 18 are no longer supported by the sealing layer 32, 68, they are dispensed by gravity from the compartment 18 into the refreshment contained in container C. As the sealing layer 32, 68 passes the lowermost end of the wall 13 or sleeve 66, any confections B that may tend to adhere to the sealing layer will be scraped therefrom by lowermost end of the wall 13 or sleeve 66.

In another alternative embodiment, instead of the perforated tear line 36, the outer uppermost annular edge of the sealing layer 32, 68 may be provided with a low-tack adhesive similar to low-tack adhesive 76 for sealing the outer edge of the sealing layer to the first lid part 12, 62 at seal 46, 70. When the consumer twists the second lid part 14, 64, the low-tack adhesive at seal 46, 70 separates from the first lid part and dispenses the confections B into the refreshment contained in container C.

After the confection B is dispensed into the container C, the user/consumer may insert a spoon or drinking straw into the container through the central opening 20 (or 66) and consume the refreshment now containing the confection B. Non-limiting examples of the applications for the dispensing lid closure of the invention include: adding solid candies, "jimmies," "sprinkles" or the like to a liquid or semi-solid refreshment; adding a liquid or solid flavorant to a cold soft drink beverage; adding a flavorant and/or sweetener and cream to a hot beverage, such as tea or coffee; and adding a granular or powdered confection to a hot or cold beverage.

Although certain presently preferred embodiments of the present invention have been specifically described herein, it will be apparent to those skilled in the art to which the invention pertains that variations and modifications of the various embodiments shown and described herein may be made without departing from the spirit and scope of the invention. Accordingly, it is intended that the invention be limited only to the extent required by the appended claims and the applicable rules of law.

What I claim is:

1. A lid closure adapted to dispense a material into a container comprising a first lid part, said first lid part having formed therein a compartment adapted to contain the material for dispensing into the container, a second lid part comprising a cap having a pair of pockets, said first lid part having an opening therein for removably receiving the second lid part, a sealing layer affixed to said first and second lid parts for sealing the material in the compartment, said sealing layer having a tear line whereby, when said cap is manually twisted by a consumer relative to the first lid part using said pockets, the sealing layer tears along the tear line and permits discharge of the material from the compartment into the container.

2. The lid closure of claim 1, wherein the opening in the first lid part is a central circular opening, the second lid part being adapted to fit in the opening, the second lid part being attached to the sealing layer radially inwardly from the tear line.

3. The lid closure of claim 2, wherein the cap is generally cylindrical and the pockets are substantially semi-cylindrical.

4. The lid closure of claim 1, wherein the sealing layer is a circular disk with a circular tear line.

5. The lid closure of claim 4, wherein the sealing layer is adhesively or heat sealingly attached to the first lid part radially outwardly of the circular tear line and is adhesively or heat sealingly attached to the second lid part radially inwardly of the circular tear line.

6. The lid closure of claim 1, wherein the material to be dispensed is a solid confection.

7. The lid closure of claim 1, wherein the compartment is an annular space surrounding the second lid part.

8. The lid closure of claim 1, wherein the sealing layer is made of a sheet material from the group comprising a metal foil, a polymeric foil, and a metal/polymeric foil laminate.

9. The lid closure of claim 1, including a label or decal applied over the first and second lid parts for sealing the second lid part to the first lid part.

10. The lid closure of claim 9, wherein the label or decal is peelable away from the lid parts to provide a consumer access to the pockets.

11. The lid closure of claim 9, including indicia printed on the label or decal.

12. The lid closure of claim 1, wherein the second lid part and a portion of the sealing layer attached to the second lid part are removable from the first lid part.

13. The lid closure of claim 1, including indicia formed in the lid.

14. The lid closure of claim 1, wherein the sealing layer is affixed to the first and second lid parts by heat sealing or adhesive.

15. The lid closure of claim 1, wherein the first and second lids are vacuum-formed of a polystyrene sheet material.

16. The lid closure of claim 1, wherein the second lid part has an annular flange and the first lid part has an annular shoulder around the opening into which the second lid part is received, the annular flange being sealed to the annular shoulder with a low-tack adhesive.

17. The lid closure of claim 1, wherein the tear line comprises a low-tack adhesive.

18. A lid closure adapted to dispense a solid confection into a container comprising a first lid part formed of a polymeric sheet material having a substantially uniform thickness, said first lid part having formed therein an annular compartment adapted to contain the confection for dispensing into the container, a second lid part formed of a polymeric sheet material having a substantially uniform thickness, said first lid part having a central circular opening therein for removably receiving the second lid part, a sealing layer bonded to said first and second lid parts for sealing the material in the compartment, said sealing layer having a circular tear line whereby, when said second lid part is rotated relative to the first lid part, the sealing layer tears along the tear line and permits discharge of the confection from the compartment into the container.

19. A method of making a dispensing lid closure for dispensing a confection into a container, said closure comprising first and second lid parts formed of sheet material, said first lid part having formed therein a central opening for receiving the second lid part and a compartment adapted to contain the material for dispensing into the container, and a sealing layer with a circular tear line formed therein, comprising the steps of:

forming the first lid part with a raised annular section and a central opening;

forming the second lid part with a pair of pockets;

inserting the second lid part into the central opening of the first lid part;

orienting the first lid part with the compartment upwardly open;

charging the upwardly open compartment with a quantity of the confection;

adhesively affixing the sealing layer to the first lid part radially outwardly of the circular tear line; and adhesively affixing the sealing layer to the second lid part radially inwardly of the circular tear line.

20. The method of claim 19, wherein the second lid part is inserted into the central opening of the first lid part and affixed to the sealing layer after the upwardly open compartment is charged with the confection.

21. A method of using a dispensing lid closure for dispensing a solid confection into a container, said closure comprising first and second lid parts formed of sheet material, said first lid part having formed therein a central opening for removably receiving the second lid part and a compartment adapted to contain the confection for dispensing into the container, and a sealing layer with a circular tear line formed therein, the sealing layer being bonded to the first and second lid parts, comprising the steps of:

securing the dispensing lid closure to the container;

rotating the second lid part so as to tear the sealing layer along the circular tear line; and removing the second lid part and a portion of the sealing layer bonded to the second lid part from the central opening of the first lid part to dispense the confection by gravity from the compartment into the container.

* * * * *